United States Patent [19]

Bittner

[11] Patent Number: 4,584,919

[45] Date of Patent: Apr. 29, 1986

[54] DRUM CUTTING MACHINE, E.G. FOR SLICING SUGAR BEET

[75] Inventor: Hans-Joachim Bittner, Hagen, Fed. Rep. of Germany

[73] Assignee: H. Putsch GmbH & Comp., Hagen, Fed. Rep. of Germany

[21] Appl. No.: 773,518

[22] Filed: Sep. 6, 1985

Related U.S. Application Data

[63] Continuation of Ser. No. 560,556, Dec. 12, 1983, abandoned.

[30] Foreign Application Priority Data

Dec. 15, 1982 [DE] Fed. Rep. of Germany ..... 3246439

[51] Int. Cl.[4] ..... B26D 1/36; B26D 3/28

[52] U.S. Cl. ..... 83/663; 83/403; 83/699

[58] Field of Search ..... 83/403, 591, 663, 674, 83/698, 699; 241/91, 277, 278

[56] References Cited

U.S. PATENT DOCUMENTS

| | | | |
|---|---|---|---|
| 1,474,797 | 11/1923 | Spicer | 83/403 |
| 2,884,974 | 5/1959 | Woodward, Jr. | 83/403 |
| 3,139,127 | 6/1964 | Urschel et al. | 83/161 |
| 4,391,172 | 7/1983 | Galland et al. | 83/403 |

FOREIGN PATENT DOCUMENTS

| | | | |
|---|---|---|---|
| 328166 | 3/1972 | U.S.S.R. | 83/403 |

*Primary Examiner*—Frank T. Yost

*Attorney, Agent, or Firm*—Bernard, Rothwell & Brown

[57] ABSTRACT

The cutting comprises a drive disc, over whose periphery detachable secured rods 12, preferably having a square cross-section, are distributed at equal spacings and are aligned parallel to the drum axis. Between each pair of adjacent rods a blade box 42 is inserted which bears all replaceable wearing parts 56, 74, 80, these being directed into the drum interior. In operation each blade box rests againt the rods, owing to plane surface contact when these rods have a polygonal or, preferably, square cross-section.

26 Claims, 3 Drawing Figures

DRUM CUTTING MACHINE, E.G. FOR SLICING SUGAR BEET

This is a continuation of application Ser. No. 560,556 filed Dec. 12, 1983, now abandoned.

The invention relates to a drum cutting machine, in particular (but not solely) for cutting sugar beet into slices, with a number of holding structures which are disposed at equal spaces over the periphery of the drum, extend substantially parallel to the axis of the drum and hold between themselves one blade box in each case, in which blade box at least one cutting blade is secured with its cutting edge directed substantially in the peripheral direction.

Various embodiments of drum cutting machines of this type are already known. Such a drum cutting machine may comprise a body which is cast in one piece and over the periphery of which holding structures for the blade boxes are provided such that they are arranged at short distances. In the ready-assembled state this drum cutting machine, i.e. its drum, forms a hollow space which is substantially closed but is axially open on one side and into which the sugar beets to be cut are fed through the afore-mentioned axial opening. In this connection the drum cutting machine is located below a sugar beet hopper such that the sugar beets are tightly packed in the drum interior so that they can be cut there into slices of a particular shape by the cutting blades which project into the drum interior and are retained in the blade boxes.

It is only possible to produce the afore-mentioned cast piece, which, being the main support body, forms the drum, in a relatively complicated manner which is in particular disadvantageous when only relatively small quantities have to be produced in a certain unit of time.

Therefore there has been a need to develop further a drum cutting machine of the type mentioned in such a way that it is favourable to manufacture the drum even in small quantities whilst ensuring simple and effective sealing of the drum with respect to the drum interior by means of detachable wearing parts, namely ensuring that the blade boxes can be easily mounted and removed, these blade boxes having to be removed from the drum at regular intervals in order to sharpen the cutting blades.

The present invention provides a drum cutting machine of the type described, in which the holding structures, which accommodate the blade boxes between them, are formed by rods which, being separate parts, are detachably connected to at least one drive disc, the rods being covered towards the drum interior by wearing parts.

As a result of the division into two parts of the body of the drum, by detachably connecting a number of individual rods in a particular alignment to a drive disc, this body can be manufactured with considerably less expense than was the case with the cast bodies of the drum cutting machines known hitherto. In particular it is possible in this connection simply to push the blade boxes from one side onto and between the rods and to fix them in the axial direction, the rods having relatively small cross-sectional dimensions which can be easily covered by wearing parts, it being possible for the latter to be mounted on the blade box itself.

The rods may have various cross-sections, for example a round or polygonal cross-section, a quadrilateral and in particular a square cross-section being preferred. In the case of a square cross-section (even in the case of a polygonal cross-section formed in a different manner, which can even be a triangular cross-section, however, one edge of the cross-section of the rods is preferably directed towards the axis of the drum, as a result of which the plane surfaces of the rods are aligned in a favourable manner in order to be able to absorb in a favourable manner—with respect to surface contact—the cutting forces and centrifugal forces occurring during operation.

In order to be able to maintain the position of the rods such that they are non-rotatably mounted, each rod is secured at at least one end by a positive engagement for example. In particular, however, each rod can be inserted at one end by means of a pin having a smaller cross-sectional dimension into the drive disc and secured by a nut, this pin having a circular cross-section for the purpose of simple manufacture. At the other end each rod engages positively by means of a recess into an external stabilizing ring which rotates freely with the rods and the other disc such that this ring, the individual rods and the drive disc form a rigid, rotating assembly which can be suspended in a cantilever manner and, finally, is further reinforced by the inserted blade boxes. When the ring is removed the blade boxes can be inserted and secured very easily from this side between the rods. The rods are firstly secured against rotation about their own axis by the positive engagement of their recesses in the stabilizing ring. A further securing in this respect occurs by means of a plurality of cover plates secured to the stabilizing ring, one of which cover plates in each case engages positively in a recess formed at the end face of each rod.

The blade boxes, which are inserted in the longitudinal direction of the rods between two rods in each case, partially engage around each of the two adjacent rods. In particular when a polygonal cross-section is used for the rods each of the blade boxes rests against at least two plane outer faces of the rod which adjoin one another via an edge, for which purpose the blade boxes comprise a prismatic recess at the side facing the respective rod.

When using a polygonal cross-section, and in particular when the rod has a quadrilateral or square cross-section, in an advantageous construction each blade box rests against the plane, substantially opposite surfaces, of two adjacent rods, each blade box substantially resting against the entire plane surface of two adjacent rods directed obliquely into the drum interior. In this connection, each blade box only partially embraces an obliquely outwardly directed surface of the rod by means of a surface which forms the prismatic recess and faces the rod in question, the blade carrier as a whole being inserted between the rods with a certain amount of play such that during operation and under the effect of the forces occuring in this connection the blade boxes do not abut against the afore-mentioned obliquely outwardly directed surfaces of the rod. There only results an abutment against the rod surfaces directed obliquely into the drum interior. where the blade boxes and the rods, however, contact each other substantially over the entire surface in such a way that the resultant forces occurring act substantially perpendicularly to the surface plane and thus the forces occurring can be initiated in a very favourable manner.

Even though a circular cross-section of the rods used is possible in principle, rods of this type are not preferred since, when the adjacent faces of the associated blade box partially engage around the rods, on account of the necessary play between the blade boxes and the rods in operation as a result of the forces occurring therein, there results such a displacement between the rods and the blade boxes that there is substantially linear contact between the two parts, which contact leads to considerable stress of the material of the parts in question as a result of the great forces occurring.

Advantageously, each blade box is retained at the end faces in the operating position, the retaining means at the end face lying at the insertion end of the rods being detachable. In an advantageous development the detachable retention means consists of a spring-loaded, pivotable locking lever which abuts on an end face of each blade box, possibly in a recess provided there. Advantageously this recess is formed by a spacer sleeve, which is mounted parallel in the rod axis, and a disc or plate which is mounted at the free end of the sleeve and has a larger cross-sectional dimension, the locking lever coming to rest positively against the end face of the blade box and inside the afore-mentioned disc or plate, the width or thickness of the locking lever not having to correspond to the length of the spacer sleeve. This solution has the advantage that all the spacer sleeves can be finished simultaneously in one operating stage by means of one grinding disc, such that in fact all the spacer sleeves are the same length and thus a precise axial alignment of all the blade boxes and the blades located thereon over the periphery of the drum is ensured when the blade boxes come to rest with the afore-mentioned disc or plate at the end faces of the rods.

The above-mentioned locking recess is preferably arranged on the side, of the blade box, against which one or more blades are pressed in abutment. This has the advantage that the distance between the stop edges for the blades in the blade box and the locking recess is relatively short and therefore it is more easily possible to adhere to narrow tolerances. These narrow tolerances are particularly important when so-called Königsfeld blades are used in the peripheral direction in the drum, the cutting tips and cutting troughs thereof being successively displaced in phase by a half pitch. It is therefore only ensured by very closely observed tolerances of the type mentioned that all the blades are in fact displaced in phase with respect to one another by a half pitch in the direction of the drum axis. By adhering to this phase displacement it is therefore possible to attain the specific cross-sectional shape of the slices desired.

According to the further development of the invention all the exchangeable wearing parts, which are directed towards the interior of the drum, may be mounted detachably on the blade box itself. The advantage of this is that these wearing parts can be easily and directly replaced when the blade boxes have to be removed from the drum for regrinding and sharpening worn blades.

According to an advantageous further development, one wearing part is formed by a clamping plate for clamping the blade in the blade box, which clamping plate is extended away from the cutting edge of the blade, over the rear edge of the blade and covering a corresponding rod. This avoids having three wearing parts at this point, which parts are detachably connected to the drum itself in the known drum cutting machines.

With respect to a particularly advantageous development, the rearward extension of this clamping plate overlaps a portion of the adjacent blade box and thus, of course, also the rod located at this point and immediately adjoins the blade arrangement of the adjacent blade box which is likewise formed by a wearing part, such that, in the case of a favourable maintained change in position of the blade arrangement and a relatively short construction thereof in this respect the entire blade box is protected towards the drum interior by one wearing part.

The afore-mentioned rearwardly extended section of the clamping plate is supported on the associated blade box, for which purpose in particular a bolt is secured on the blade box and supports the rearwardly extended section of the clamping plate. Advantageously this bolt engages postively in a recess of the clamping plate. As a result of this support the rearward extension, of the clamping plate, which overhangs to a relatively great degree, is not bent by the forces which occur during operation and act outwardly and thus it cannot strike the adjacent blade box.

Finally, there are provided in an advantageous development lateral wearing strips, of a respective blade box, which extend in the peripheral direction of the drum and likewise overlap a rod and part of an adjacent blade box, namely to the same extent as the clamping plate, such that the blade boxes which are arranged in rows adjacent one another in the peripheral direction follow one another in a satisfactory manner.

It should also be mentioned that the afore-mentioned locking lever may be coupled with signal transmitters which signal the position of the locking lever in each case and thus inform the operator as to whether the respective blade boxes are axially secured or not in the drum.

In addition, reference is also made to the fact that preferably unbent, cranked Königsfeld blades are used instead of bent cranked Königsfeld blades. The advantage of this is that these blades can be displaced in a fixed plane according to the length, shortened by sharpening, and after the clamping plate has been removed, without the transverse distance with respect to the blade arrangement changing as a result of the shortening of the blades, which would be the case if one were to use bent cranked Königsfeld blades were used which are approximately adapted to the periphery of the drum by bending.

The invention will be described further, by way of example only, with reference to the accompanying drawings, in which.

Figure 1:
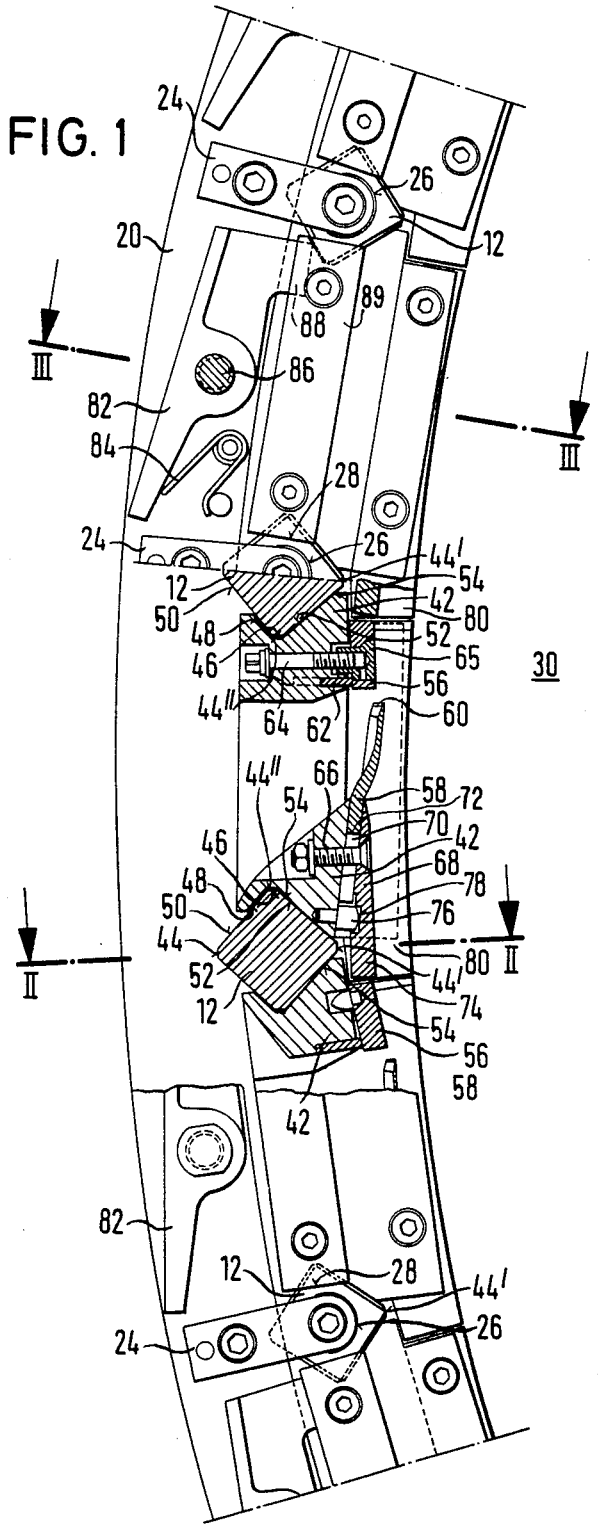
FIG. 1 shows an axial partial view of the drum of a drum cutting machine for sugar beet viewed partially in section.

In the embodiment illustrated in the drawings the drum of the drum cutting machine is suspended in a cantilever manner and is rotatably mounted such that it is possible to provide the drum with the blade boxes from the free, unmounted side of the drum. One portion of the rotatably mounted drive disc 10 is shown in section in FIG. 2. A plurality of rods 12 are detachably fastened along the outer periphery of the drive disc 10 at equal spacings, the rods extending with their longitudinal axes parallel to the drum axis. The rods can be seen very clearly in section in FIG. 1 and in side view in FIG. 2.

Figure 2:
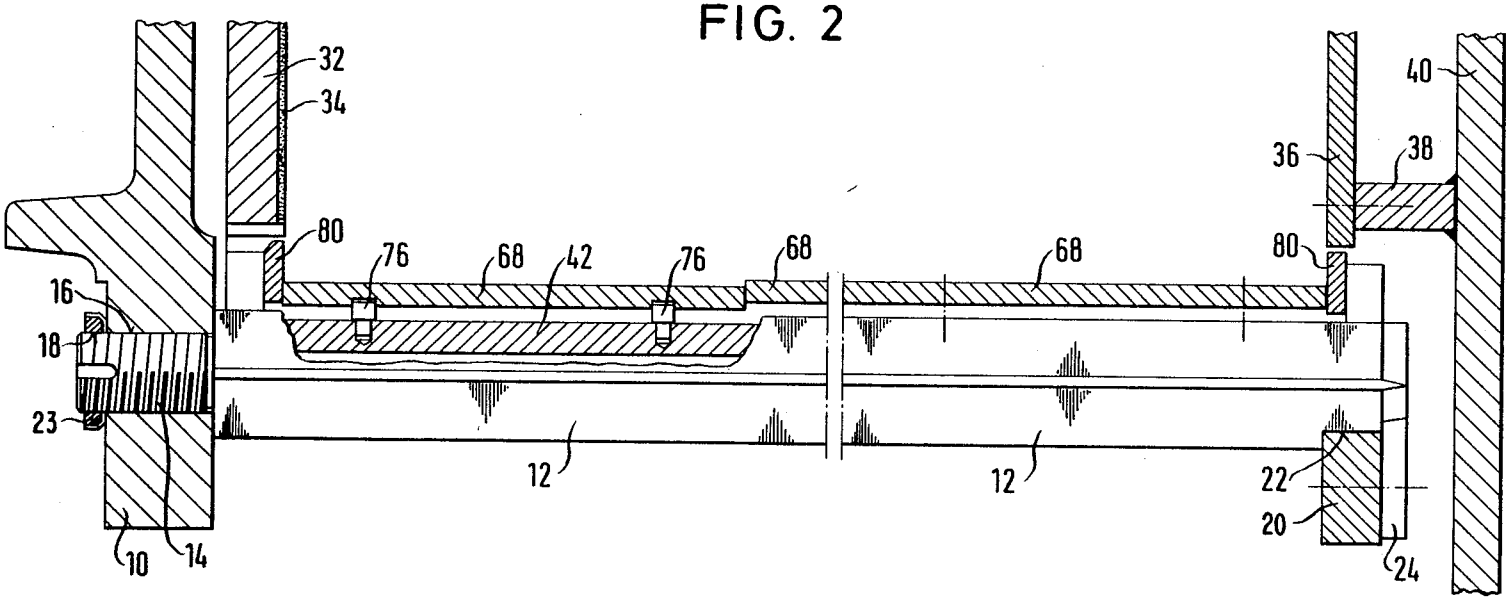
FIG. 2 shows a section through the drum according to FIG. 1 along the line II—II but showing the portions broken away in FIG. 1, the drum further including a closing plate supported by a machine frame.

As can likewise be clearly seen from FIG. 2, each rod 12 is inserted into a corresponding bore 16 in the drive disc 10 by means of a pin 14, which has a circular cross-section with a smaller diameter than the cross-sectional dimension of the rod. At their free end each pin 14 has an external thread 18 onto which a nut 23 is screwed, by means of which each rod 12 is secured individually on the drive disc 10. This securing, however, is not sufficient for non-rotatable fastening. For this purpose, at the opposite end of the rods, there is provided a stabilizing ring 20 which embraces all the rods, but otherwise has no further support and engages positively in a recess 22 in the outer periphery of each rod 12. This can be seen clearly in FIG. 2 at the righthand end of the drawing. As a result of the positive engagement of the stabilizing ring 20 in the recess 22 of the rod 12 this rod is non-rotatably retained. A further non-rotatable retention is obtained by means of a holding plate 24 which is secured on the outer side of the stabilizing ring 20. This holding plate 24 projects positively into a matching recess 26 in the free end face 28 of the rod 12. This is clearly shown in FIG. 1.

The drum forms a substantially closed interior 30 which is closed in the radial direction by the blade boxes, yet to be described, and axially, on the side of the drive disc 10, by a closing plate 32, which is plated with a wear-resistant material 34, and, on the opposite axial side by a closing plate 36 which is secured on the machine frame 40 by means of crosspieces 38. On one axial side the interior 30 of the drum is openly accessible so that the sugar beets to be cut can be inserted there.

From the free side of the rods 12, i.e. the side lying opposite the drive disc 10, one blade box 42 in each case is inserted between two adjacent rods 12, which can be seen particularly well in FIG. 1. In the embodiment illustrated the rods 12 used have a square cross-section with blunted edges 44. The rods are aligned with respect to the drum axis in such a way that an inner edge 44' of the rods is directed towards the drum axis and a straight line connecting this edge 44' and the opposite edge would extend through the drum axis. The edges 44", of adjacent rods 12, which are substantially directed towards one another are embraced by sections of the blade box 42 by means of a prismatic recess 46, such that one face 48 of the prismatic recess 46 partially embraces the obliquely outwardly directed plane surface 50 of the associated rod 12 in each case. The other face 52 of the prismatic recess 46 abuts substantially against the entire obliquely inwardly directed plane surface 54 of the rod 12, the above-mentioned face 48 not resting against the above-mentioned plane surface 50 when the drum cutting machine is in operation and, owing to the cutting and centrifugal forces of the blade boxes 42 occurring, presses with the face 52 mentioned against the plane surface 54 of the associated rod 12, all the forces occurring in this connection being transmitted via surface contact to the rods. As a result of the particular alignment of the rods the resulting force acts substantially perpendicularly to the contact face between the blade box and a rod.

In the region of one of the two rods accommodating a blade box 42 there is a blade arrangement 56 which is located in the blade box 42 and is formed as a wearing part and, on the side of the other rod, there is a cutting blade 58 which is substantially aligned in the peripheral direction and whose cutting edge 60, in this connection, is at a particular distance from the blade arrangement 56.

The blade arrangement 56 can be adjusted by means of a wedge key 62 (FIG. 1). The blade arrangement 56 is secured to the blade box 42 by means of a fastening screw 64 and an arrangement nut 65 located in the cutting arrangement.

The cutting blade 58 is clamped in the desired position in the blade box 42 by means of clamping screws 66 and a clamping plate 68, it being possible for the cutting blade, formed as a cranked, unbent Königsfeld blade, to be readjusted in its longitudinal direction by an elongate hole 70 in the region of the clamping screw.

As has already been stated, the clamping plate 68 is formed as an interchangeable wearing part and, for this purpose, is provided over the rear edge 72 of the cutting blade 58 with a rearwardly extended section 74 which covers not only the free part of the rod 12 but also a certain section of the adjacent blade box 42, which is not covered by the blade arrangement 56 located there and is likewise formed as a wearing part. This rearwardly extended section 74 of the clamping plate 68 is supported by means of a bolt 76 secured in the blade box 42 against the forces acting from the interior, the bolt engaging positively in a recess 78 of the rearwardly extended section 74 of the clamping plate 68.

FIG. 2 shows that in the axial direction three clamping plates 68, and thus also associated cutting blades, are disposed one behind the other. It can also be seen that lateral wearing strips 80 are mounted on the blade box 42 as a lateral limitation of the interior 30, which strips 80 likewise overlap the associated rod 12 and the adjacent blade box to the same extent as the rearwardly extended section 74 of the respective clamping plate 68, i.e. as far as the blade arrangement 56 of the adjacent blade box, as can be seen in particular from FIG. 1.

Figure 3:
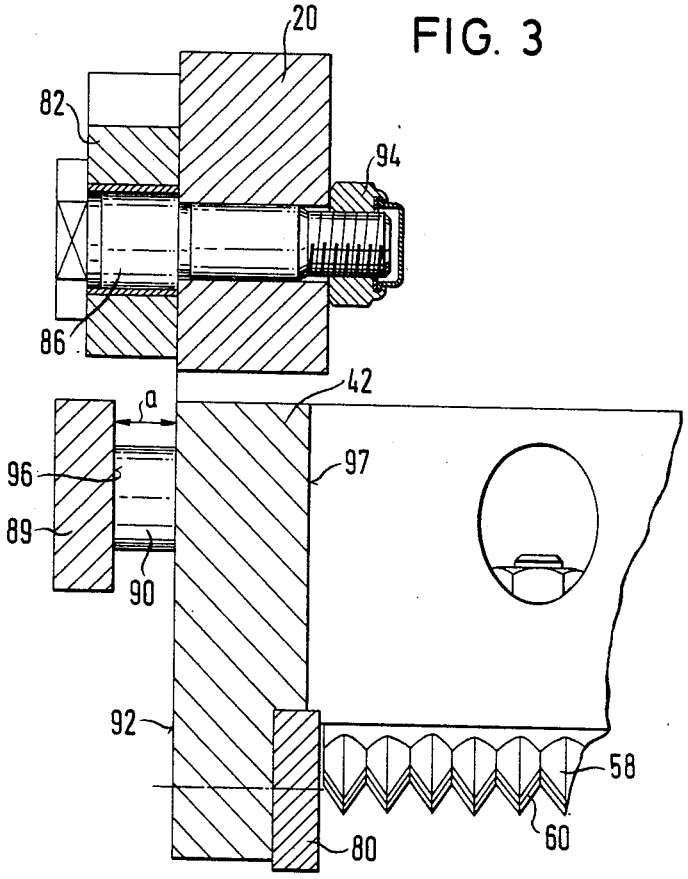
FIG. 3 shows a partial section along the line III—III in FIG. 1, illustrating axial locking apparatus for the blade boxes.

The blade boxes, which are inserted between two rods in each case, still have to be fixed in the axial direction in the inserted state. This occurs, as can be seen from FIG. 1 in particular, by means of locking levers 82, which can be pivoted about a shaft 86 such that they are pre-stressed in the locking position by a spring 84. As can be seen in particular from FIGS. 1 and 3, a locking projection 88 of this locking lever engages behind a disc or plate 89 which abuts at the end face against at least two rods, is secured by two spacer sleeves 90 at the end face 92 of the blade box 42, and abuts against the end face of each respective blade box so as to be axially retained. The shaft 86 of the locking lever 82 is mounted in the stabilizing ring 20 and is fixed there by means of a nut 94. The disc or plate 89 defines with its inner face 96 a distance a with respect to the end face 92 so as to form a recess for accommodating the locking projection. When the locking projection engages, it strikes against the spacer sleeve 90. If there is no blade box between the rods then the locking projection strikes against the associated rod 12.

Although it is not illustrated, signal transmitters can be associated with the locking lever 82 which indicate the respective position of the locking lever and thus the actual locking of the blade boxes.

At the side of the blade box 42, at which the above-mentioned disc or plate 89 and the spacer sleeves 90 are arranged, i.e. at the side where the blade box is locked axially, there is also a stop face 97 for the blades 58 such that there is only a very small tolerance path for the axial alignment of the blades. This enables small tolerances to be observed for the alignment of the blades in the axial direction. This is particularly important when blades alternate in the peripheral direction, which blades are displaced in phase in the axial direction of the drum by a pitch of the blade tips, in order to obtain a particular desired slice shape. This displacement in phase can be kept as accurate as possible as a result of these narrow tolerances.

I claim:

1. A cutting blade-holding drum for a drum cutting machine for slicing sugar beet, comprising a drum having an axis and a plurality of holding structures which are arranged at equal distances over the periphery of the drum and extend substantially parallel to the drum axis, and a plurality of blade boxes, each blade box being held between two of the holding structures and securing a cutting blade therein, the cutting blade having its cutting edge directed substantially in the peripheral direction of the drum, in which the holding structures comprise rods which, as separate parts, are detachably connected to at least one drive disc, the rods being covered towards the drum interior by wearing parts.

2. A drum as claimed in claim 1, in which the rods have a circular cross-section.

3. A drum as claimed in claim 1, in which the rods have a polygonal cross-section.

4. A drum as claimed in claim 3, in which the rods have a quadrilateral cross-section.

5. A drum as claimed in claim 4, in which the rods have a square cross-section.

6. A drum as claimed in claim 4, in which an edge of each of the rods is directed towards the drum axis.

7. A machine as claimed in claim 1, in which each rod is secured against rotation at an end of each rod by a positive engagement.

8. A machine as claimed in claim 7, in which an end of each rod is provided with a pin having a smaller cross-sectional dimension than the remainder of the rod inserted into the drive disc and secured by a nut, and another end of the rod engages positively with a stabilizing ring which lies on the exterior and rotates freely with the rods and the drive disc.

9. A machine as claimed in claim 8, including a plurality of cover plates secured on the stabilizing ring, each cover plate engaging positively in a respective recess in an end face of each rod.

10. A drum as claimed in claim 1, in that each blade box is inserted endwise in the longitudinal direction of the rods between two rods and, in this way, partially engages around each of the two rods.

11. A drum as claimed in claim 10, in which the said two rods are of polygonal cross-section and the blade box rests against at least two adjacent plane faces of each of the said two rods, the blade box for this purpose having two prismatic recesses disposed opposite one another.

12. A drum as claimed in claim 11, in which the rods are quadrilateral in cross-section, one edge of each rod is directed towards the drum axis, blade box rests against the plane, substantially opposite surfaces of the said two rods.

13. A drum as claimed in claim 12, in which the blade box rests against substantially the entire plane surface of each of the said two rods which is directed obliquely into the drum interior and covers at least only partially the adjacent outwardly directed surface of each rod.

14. A drum as claimed in claim 1, in which each blade box is retained at its end faces in an operating position, the retaining means adjacent the insertion end of the rods (12) being detachable.

15. A drum as claimed in claim 14, in which the detachable retaining means comprises a spring-loaded, pivotable locking lever whose end rests against a respective blade box.

16. A drum as claimed in claim 15, in which the end of the lever rests in a recess (a) provided adjacent the end of the blade box.

17. A drum as claimed in claim 16, in which the recess (a), which is provided on the end face of the blade box, is formed by a spacing sleeve, mounted parallel to the axis of the rod, and a disc which is mounted on the spacer sleeve at the free end thereof, has a greater cross-sectional dimension than the spacer sleeve, and comes to rest against the rod.

18. A drum as claimed in claim 16, in which the locking recess is disposed at the end face of the blade box against which end face at least one blade is pushed in abutment.

19. A drum as claimed in claim 1, in which all the wearing parts directed towards the drum interior are detachably connected to the blade box.

20. A drum as claimed in claim 19, in which one wearing part is formed by a clamping plate which is extended away from the cutting blade edge beyond the rear edge of the blade and covering a corresponding rod.

21. A drum as claimed in claim 20, in which the rearwardly extended section of the clamping plate overlaps a portion of an adjacent blade box.

22. A drum as claimed in claim 20, in which the rearwardly extended section of the clamping plate is supported on the associated blade box.

23. A drum as claimed in claim 22, in which the rearwardly extended section of the clamping plate is supported by at least one bolt secured on each blade box.

24. A drum as claimed in claim 23, in which the bolt engages positively in a recess of the clamping plate.

25. A drum as claimed in claim 21, in which lateral wearing strips—of one blade box in each case—which extend in the peripheral direction of the drum, overlap one of the rods and part of an adjacent blade box, to the same extent as the clamping plate.

26. A cutting blade-holding drum for a drum cutting machine, comprising a drum having an axis and a plurality of holding structures which are arranged at equal distances over the periphery of the drum and extend substantially parallel to the drum axis, and a plurality of blade boxes, each blade box being held between two of the holding structures and securing a cutting blade therein, the cutting blade having its cutting edge directed substantially in the peripheral direction of the drum, in which the holding structures comprise rods which, as separate parts, are detachably connected to at least one drive disc, the rods being covered towards the drum interior by wearing parts.

* * * * *